US010070712B2

(12) United States Patent
Wronski et al.

(10) Patent No.: US 10,070,712 B2
(45) Date of Patent: Sep. 11, 2018

(54) UTILITY BACKPACK

(71) Applicants: Vicki C. Wronski, Fuquay-Varina, NC (US); Gregory Edward Wronski, Fuquay-Varina, NC (US)

(72) Inventors: Vicki C. Wronski, Fuquay-Varina, NC (US); Gregory Edward Wronski, Fuquay-Varina, NC (US)

( * ) Notice: Subject to any disclaimer, the term of this patent is extended or adjusted under 35 U.S.C. 154(b) by 186 days.

(21) Appl. No.: 14/996,712

(22) Filed: Jan. 15, 2016

(65) Prior Publication Data

US 2016/0324300 A1 Nov. 10, 2016

Related U.S. Application Data

(60) Provisional application No. 62/081,046, filed on Nov. 18, 2014.

(51) Int. Cl.

| | |
|---|---|
| ***A45F 3/04*** | (2006.01) |
| ***A45C 13/40*** | (2006.01) |
| *A45F 3/12* | (2006.01) |

(52) U.S. Cl.

CPC ..... *A45F 3/04* (2013.01); *A45C 13/40* (2013.01); *A45F 2003/127* (2013.01)

(58) Field of Classification Search

CPC ..... A45F 3/04; A45F 2003/127; A45F 2003/045; A45C 13/40; A45C 13/02

See application file for complete search history.

(56) References Cited

U.S. PATENT DOCUMENTS

| | | | | | |
|---|---|---|---|---|---|
| 5,004,134 | A * | 4/1991 | Barry | A45C 3/10 | 224/235 |
| 5,573,166 | A * | 11/1996 | Leja | A45F 3/04 | 224/630 |
| 5,893,504 | A * | 4/1999 | Baronian | A45F 3/04 | 224/627 |
| 6,626,342 | B1 * | 9/2003 | Gleason | A45F 3/08 | 224/633 |
| 2007/0062995 | A1 * | 3/2007 | Kasuli | A45F 3/04 | 224/637 |
| 2007/0108248 | A1 * | 5/2007 | Hoffmeier | A45C 5/06 | 224/650 |
| 2013/0175310 | A1 * | 7/2013 | Turner | A45F 3/04 | 224/637 |
| 2015/0122860 | A1 * | 5/2015 | Berei | A45F 3/04 | 224/576 |
| 2016/0278507 | A1 * | 9/2016 | Ponx | A45F 3/04 | |
| 2016/0345713 | A1 * | 12/2016 | Pepic | A45C 13/40 | |

* cited by examiner

*Primary Examiner* — Corey Skurdal
(74) *Attorney, Agent, or Firm* — Dunlap Bennett & Ludwig PLLC

(57) ABSTRACT

A utility backpack is provided with the functionality to simultaneously accommodate and carry bulky and elongated unwieldy items, especially when the elongated items have a pointy end. The utility backpack provides a bottom wall, at least one sidewall, a rear wall and front wall forming a main enclosure dimensioned and adapted for accommodating the bulky unwieldy items. The rear wall provides a sleeve that extends to the bottom wall, whereat a bottom mesh provides the floor for the sleeve as well as at least a portion of the main enclosure. The sleeve is dimensioned and adapted to accommodate the elongated unwieldy items having a pointy end, wherein the pointy end(s) protrude(s) through the bottom mesh, further accommodating the unwieldy items as well as preventing puncture damage to the utility backpack.

10 Claims, 4 Drawing Sheets

UTILITY BACKPACK

CROSS-REFERENCE TO RELATED APPLICATION

This application claims the benefit of priority of U.S. provisional application No. 62/081,046, filed 18 Nov. 2014, the contents of which are herein incorporated by reference.

BACKGROUND OF THE INVENTION

The present invention relates to carrying devices and, more particularly, to a utility backpack with the functionality to simultaneously accommodate and carry bulky and elongated unwieldy items, especially when the elongated items have a pointy end.

Currently there is no adequate hands-free solution for an individual to carry on their back both bulky and elongated unwieldy items, especially when the elongated items may have a pointy end, such as the stake end of an umbrella pole. And so typically the individual would need to use at least one of their hands to carry both such bulky and elongated unwieldy items even if they had a backpack.

As can be seen, there is a need for a utility backpack with the functionality to simultaneously accommodate and carry bulky and elongated unwieldy items, especially when the elongated items have a pointy end.

SUMMARY OF THE INVENTION

In one aspect of the present invention, a utility backpack for simultaneously accommodating and transporting at least one bulky item and at least one elongated item includes a plurality of walls defining a main enclosure dimensioned and adapted to accommodate the at least one bulky item; the plurality of walls has a bottom wall and a rear wall generally orthogonally joined to the bottom wall; an elongated sleeve disposed along the rear wall, wherein a terminus of the elongated sleeve is adjacent to the bottom wall, wherein the elongated sleeve forms a lumen dimensioned and adapted to accommodate the at least one elongated item; and a bottom mesh provided along both the terminus of the elongated sleeve and along at least a portion the bottom wall.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a utility backpack with the functionality to simultaneously accommodate and carry bulky and elongated unwieldy items, especially when the elongated items have a pointy end. The utility backpack provides a bottom wall, at least one sidewall, a rear wall and front wall forming a main enclosure dimensioned and adapted for accommodating the bulky unwieldy items. The rear wall provides a sleeve that extends to the bottom wall, whereat a bottom mesh provides the floor for the sleeve as well as at least a portion of the main enclosure. The sleeve is dimensioned and adapted to accommodate the elongated unwieldy items having a pointy end, wherein the pointy end(s) protrude(s) through the bottom mesh, further accommodating the unwieldy items as well as preventing puncture damage to the utility backpack.

Figure 1:
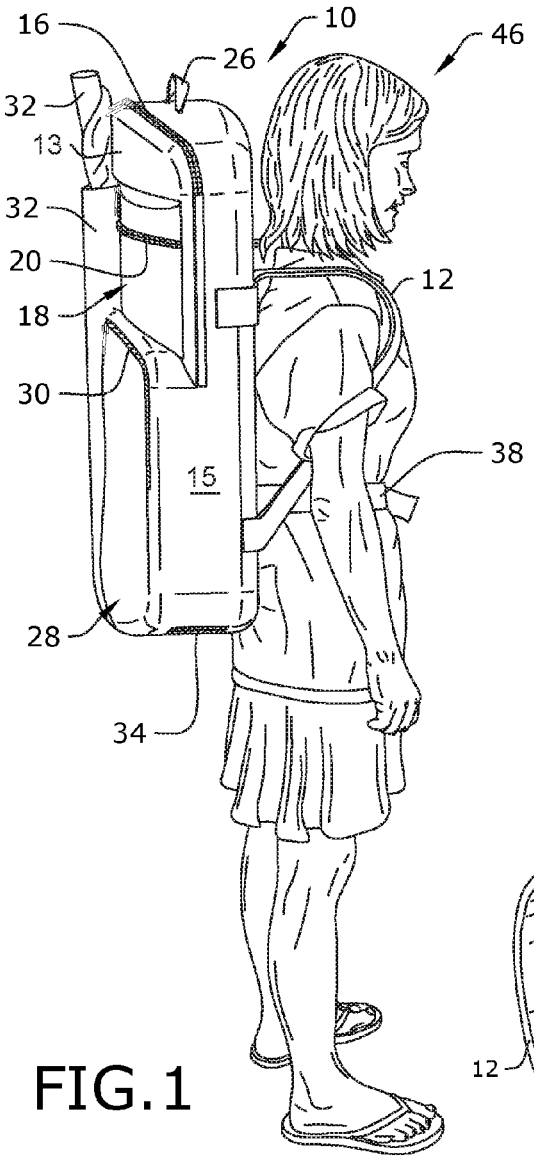
FIG. 1 is a perspective view of an exemplary embodiment of the present invention, shown in use.
Figure 2:
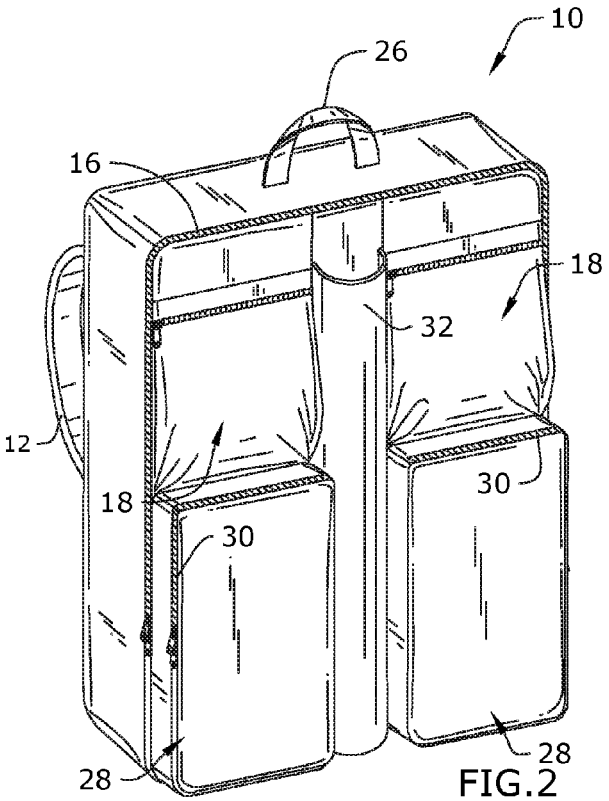
FIG. 2 is a rear perspective view of an exemplary embodiment of the present invention.
Figure 3:
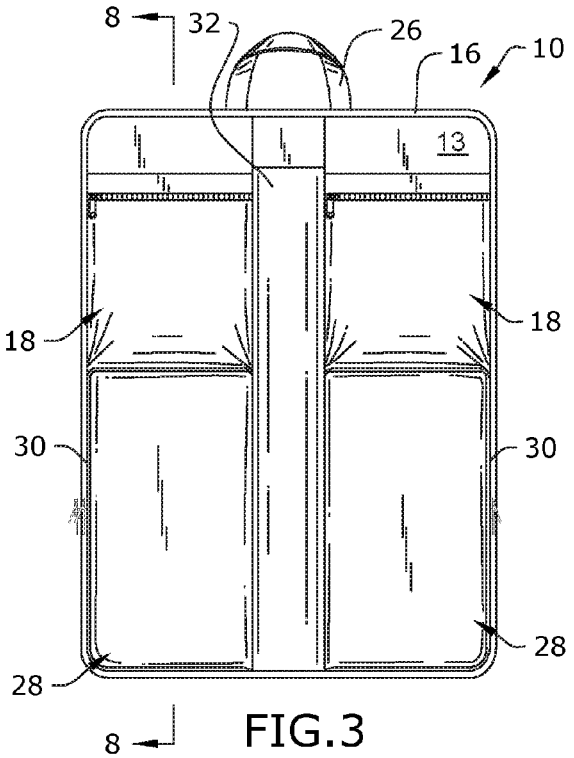
FIG. 3 is a rear view of an exemplary embodiment of the present invention.
Figure 4:
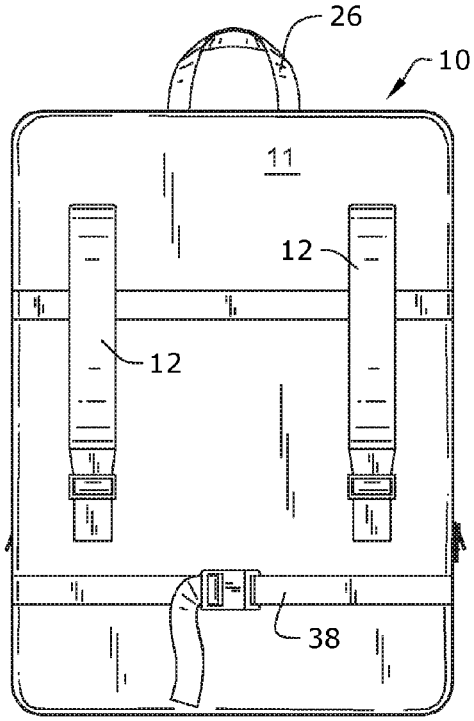
FIG. 4 is a front view of an exemplary embodiment of the present invention.
Figure 5:
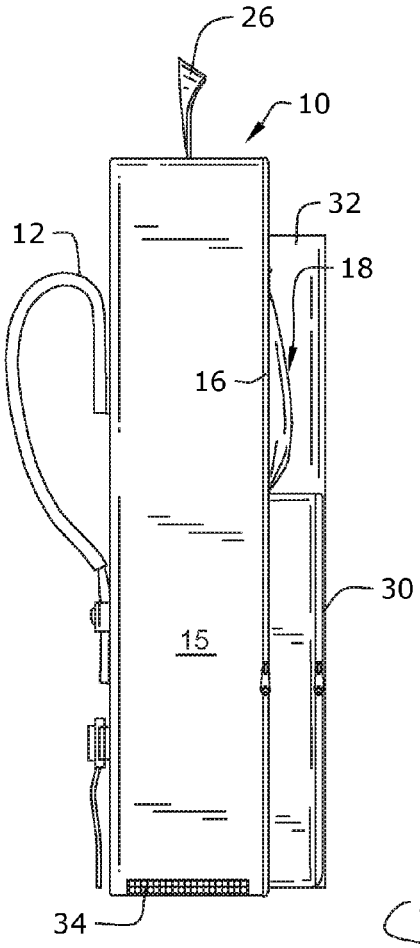
FIG. 5 is a side view of an exemplary embodiment of the present invention.
Figure 6:
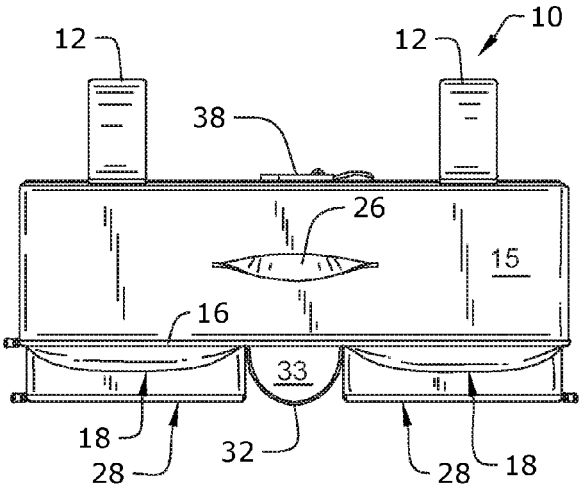
FIG. 6 is a top view of an exemplary embodiment of the present invention.
Figure 7:
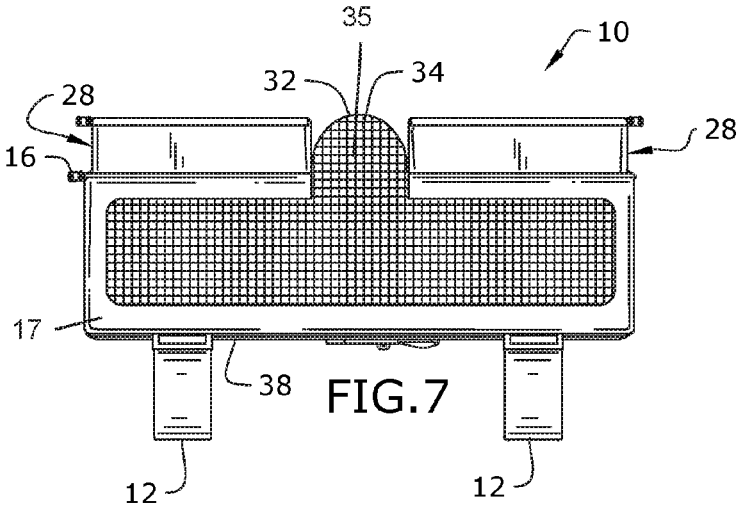
FIG. 7 is a bottom view of an exemplary embodiment of the present invention.
Figure 8:
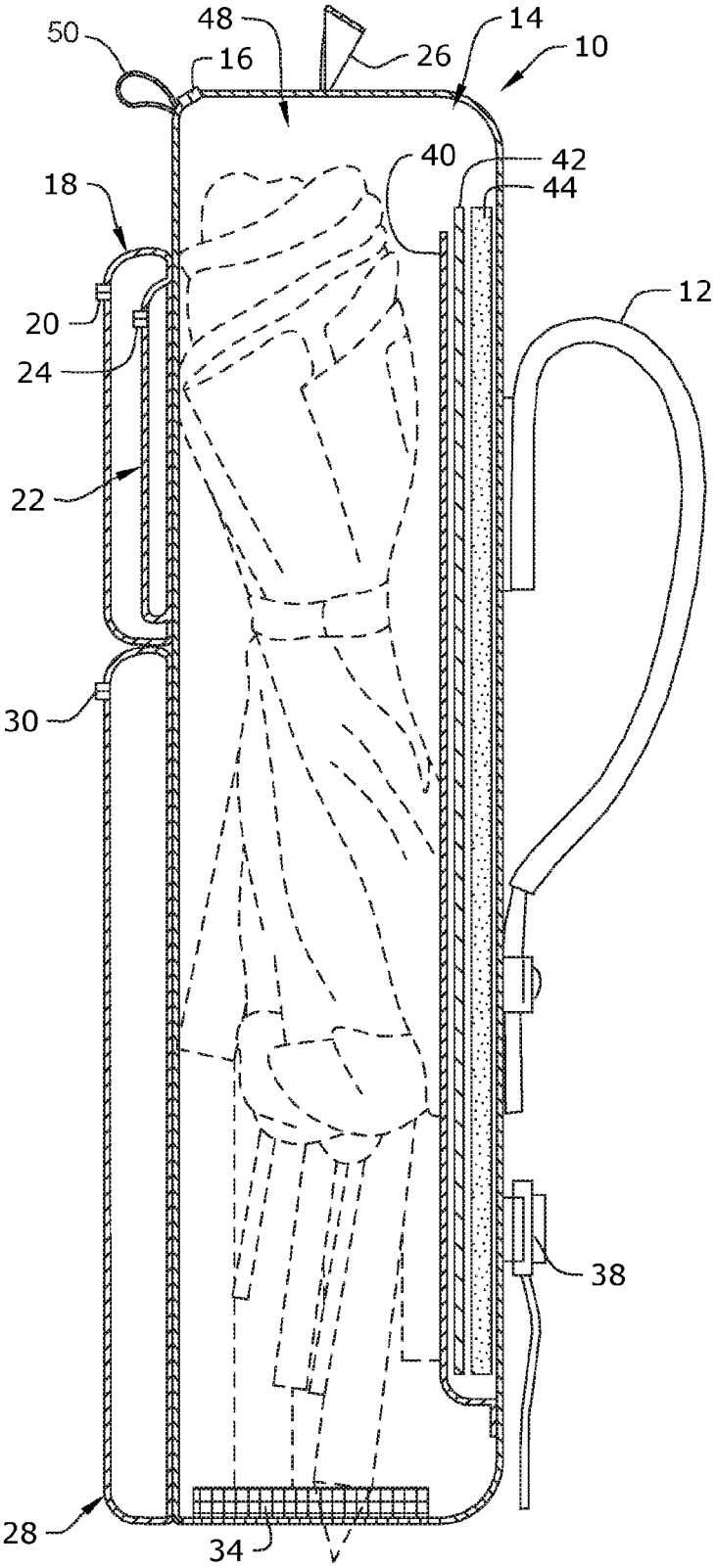
FIG. 8 is a section view of an exemplary embodiment of the present invention, taken along line 8-8 in FIG. 3.

Referring to FIGS. 1 through 8, the present invention may include a utility backpack 10 with the functionality to simultaneously accommodate and carry bulky and elongated unwieldy items, especially when the elongated items have a pointy end. The utility backpack 10 may provide a front wall 11, a rear wall 13, and at least one sidewall 15 that interconnects the peripheries of the front wall 11 and the rear wall 13 so as to form a main enclosure 14. A detachable fastener 16 may be disposed between the periphery of the rear wall 13 and the at least one sidewall 15 for accessing and sealing the main enclosure 14. The main enclosure 14 may be dimensioned and adapted for accommodating bulky, non-elongated unwieldy items 48, such as beach chairs for example. An inner main pouch 40 may be disposed within the space afforded by the main enclosure 14, as illustrated in FIG. 8. A lumbar support foam 44 and a rigid plate 42 may be disposed within a space afforded by the inner main pouch 40, wherein the lumbar support foam 44 is disposed nearer to the front wall 11.

The at least one side wall 15 may provide a handle 26 dimensioned and adapted for the user 46 to manually handle and carry the utility backpack 10. The at least one side wall 15 may include bottom wall 17. A portion of the bottom wall 17 provides a bottom mesh 34. The bottom mesh 34 may be any material that is resilient so as to allow for substantially expansion under gravitational loading of the unwieldy items 48 and 36, stretching the bottom mesh 34, and so affording more space within the main enclosure 14. Furthermore, the formacious nature of the bottom mesh 34 facilitates pointed objects, such as the ground-end of a beach umbrella 36, to protrude through the void areas defined by the areas of non-intersection of the bottom mesh 34, as illustrated in FIG. 8, thereby preventing undesirable punctures and tears in the bottom wall 17.

The rear wall 13 may provide a plurality of upper rear compartments 18 and lower rear compartments 28, wherein each compartment 18 and 28 provides a detachable fastener 20 and 30, respectively, for accessing and sealing the compartment space afforded by each compartment 18 and 28. In certain embodiments, the rear lower compartments 28 may be larger than the upper rear compartments 18 so that the rear lower compartments 28 extend a distance along and away from the rear wall 13 compared to the upper rear compartments 18, as illustrated in the FIGS. 1, 2, 5 and 6. An inner upper rear compartment 22 may be disposed within the compartment space afforded by each upper rear compartment 18, as illustrated in FIG. 8. Each inner upper rear compartment 22 may provide a detachable fastener 24 for accessing and sealing the compartment space afforded by the upper rear compartment 22. Separately, the lower rear compartments 28 may provide inner lower rear compartment, not shown, similar to the inner upper rear compartments 22. A hook 50 for hanging or manually moving the utility backpack 10 may be provided on the rear wall 13.

A semi-tubular sleeve 32 may be disposed along the rear wall 13, wherein a portion of the rear wall 13 and the semi-tubular sleeve 32 form a tubular element and a lumen 33 thereof. The sleeve/lumen 32/33 may be dimensioned and adapted for accommodating the elongated unwieldy items 36, such as beach umbrellas for example. The sleeve 32 may extend from an upper portion of the rear wall 13 to the bottom wall 17 so that a portion of the bottom mesh 34 forms a floor 35 to the sleeve 32, closing off the lumen 33 thereat, thereby affording the same advantages for the sleeve 32 as discussed above in regards to the main enclosure 14.

The front wall 11 may provide shoulder straps 12 and a waist strap 38, each dimensioned and adapted to accommodate a user's 46 shoulders and waist, respectively, for carrying the utility backpack 10 on the back of a user 46.

The material of the walls and compartments of the utility backpack 10 may include outdoor fade, insulated, durable, waterproof fabric or the like. The detachable fasteners may be made from rust and corrosive resistant material. The straps by may be made of synthetic, strong material such as nylon. The bottom mesh 34 may be made of synthetic nylon webbing. The above mentioned components may be connected using commercial grade synthetic threading.

A method of using the present invention may include the following. The utility backpack 10 disclosed above may be provided. A user 46 may fill the main enclosure 14 with at least one bulky, unwieldy item 48, such as beach chairs and the like, along with other items needed including towels, food stuff, etc. The user 46 may then place an elongated item 36 with a pointy end in the lumen 33 of the sleeve 32 so that the pointy end against or protruding through the bottom mesh floor 35, as illustrated in FIG. 8. Then the user 46 may don the utility backpack 10 on their back using the straps 18 and 28 to transport all the items 48 and 36 hands free to a desired location, such as the beach.

It should be understood, of course, that the foregoing relates to exemplary embodiments of the invention and that modifications may be made without departing from the spirit and scope of the invention as set forth in the following claims.

What is claimed is:

1. A utility backpack for simultaneously accommodating and transporting at least one bulky item and at least one elongated item, comprising:

a plurality of walls defining a main enclosure dimensioned and adapted to accommodate the at least one bulky item;

the plurality of walls comprising a bottom wall and a rear wall generally orthogonally joined to the bottom wall;

an elongated sleeve disposed along the rear wall, wherein a terminus of the elongated sleeve is adjacent to the bottom wall, wherein said bottom wall and said terminus are contiguous, wherein the elongated sleeve forms a lumen dimensioned and adapted to accommodate the at least one elongated item; and a bottom mesh provided along both the terminus of the elongated sleeve and along at least a portion the bottom wall.

2. The utility backpack of claim 1, wherein the at least one elongated item is a beach umbrella.

3. The utility backpack of claim 2, wherein the at least one bulky item is a beach chair.

4. The utility backpack of claim 1, further comprising an inner main pouch disposed in a space afforded by the main enclosure.

5. The utility backpack of claim 4, further comprising a lumbar support foam and a rigid plate, both disposed in a pouch space afforded by the inner main pouch.

6. The utility backpack of claim 5, wherein the inner main pouch is disposed along the rear wall, and wherein the lumbar support foam is disposed nearer to the front wall than the rigid plate.

7. The utility backpack of claim 5, further comprising two should straps and a waist strap disposed on the plurality of walls.

8. The utility backpack of claim 1, wherein said elongated sleeve extends substantially an entire length of the rear wall.

9. The utility backpack of claim 1, wherein the bottom mesh is provided along both the terminus of the elongated sleeve and substantially the entire bottom wall.

10. The utility backpack of claim 1, wherein the bottom mesh is of a formacious nature such as to allow pointed objects to protrude through void areas defined by areas of non-intersection of the bottom mesh.

* * * * *